US010809002B2

(12) United States Patent
Schuetz

(10) Patent No.: US 10,809,002 B2
(45) Date of Patent: Oct. 20, 2020

(54) METHOD AND DEVICE FOR OPTIMIZED FREEZE-DRYING OF A PHARMACEUTICAL PRODUCT

(71) Applicant: PROJECT PHARMACEUTICS GMBH, Martinsried (DE)

(72) Inventor: Andreas Schuetz, Martinsried (DE)

(73) Assignee: PROJECT PHARMACEUTICS GMBH, Martinsried (DE)

( * ) Notice: Subject to any disclaimer, the term of this patent is extended or adjusted under 35 U.S.C. 154(b) by 265 days.

(21) Appl. No.: 15/547,196

(22) PCT Filed: Feb. 4, 2016

(86) PCT No.: PCT/IB2016/050559
§ 371 (c)(1),
(2) Date: Jul. 28, 2017

(87) PCT Pub. No.: WO2016/125095
PCT Pub. Date: Aug. 11, 2016

(65) Prior Publication Data

US 2018/0023893 A1 Jan. 25, 2018

(30) Foreign Application Priority Data

Feb. 4, 2015 (LU) ..... 92648

(51) Int. Cl.
*F26B 5/06* (2006.01)
*F26B 9/06* (2006.01)
(Continued)

(52) U.S. Cl.
CPC ..... *F26B 5/06* (2013.01); *B65B 3/003* (2013.01); *B65B 7/2821* (2013.01);
(Continued)

(58) Field of Classification Search
CPC .. F26B 5/06; F26B 5/12; F26B 25/063; B65B 7/2807; B65B 7/2814; B65B 7/2821; B65B 7/2842; B65B 31/027
(Continued)

(56) References Cited

U.S. PATENT DOCUMENTS 3,286,366 A * 11/1966 Seligman ..... A23L 3/44 34/92
3,293,772 A * 12/1966 Gottfried ..... F26B 5/06 34/92
(Continued)

FOREIGN PATENT DOCUMENTS

BG 50458 A1 8/1992
CA 2785991 6/2011
(Continued)

*Primary Examiner* — John P McCormack
(74) *Attorney, Agent, or Firm* — Riverside Law LLP

(57) ABSTRACT

A method for lyophilizing a substance is provided which may include placing at least one vial containing the substance in a lyophilization chamber, the at least one vial having an opening in which a stopper is inserted in a closed state not allowing gas exchange between the interior and exterior of the vial; providing mechanical means external to the stopper and arranged at the opening for restricting an upward movement of the stopper; lowering the temperature within the lyophilization chamber to a predefined value below the freezing temperature of the substance and reducing the pressure within the lyophilization chamber to a predefined pressure at a predefined temperature, the predefined pressure being chosen such that the force exerted by it on the stopper lifts the stopper from the closed state to an exchange state in which the stopper is only partly inserted in the opening of the vial allowing gas exchange between the interior and exterior of the vial, wherein the lowering of the temperature within the lyophilization chamber to the predefined value is performed before reducing the pressure
(Continued)

within the lyophilization chamber to the predefined pressure and wherein lifting the stopper from the closed state abruptly lowers the pressure within the at least one vial which initiates nucleation in the substance within that vial. In addition, mechanical means is provided which may be used in order to perform the method for lyophilizing a substance.

8 Claims, 3 Drawing Sheets

(51) Int. Cl.

| | |
|---|---|
| ***F26B 25/16*** | (2006.01) |
| ***B65D 25/10*** | (2006.01) |
| ***B65B 3/00*** | (2006.01) |
| ***B65B 7/28*** | (2006.01) |
| *B65B 31/02* | (2006.01) |
| *B65D 51/24* | (2006.01) |

(52) U.S. Cl.
CPC ..... *B65D 25/108* (2013.01); *F26B 9/066* (2013.01); *F26B 25/16* (2013.01); *B65B 31/027* (2013.01); *B65D 51/241* (2013.01)

(58) Field of Classification Search
USPC ..... 34/296, 297, 284, 285, 286, 287, 289
See application file for complete search history.

(56) References Cited

U.S. PATENT DOCUMENTS

| | | | | |
|---|---|---|---|---|
| 3,668,819 | A * | 6/1972 | Henshaw | B65B 31/027 53/102 |
| 5,964,043 | A * | 10/1999 | Oughton | F26B 5/06 34/284 |
| 2005/0086830 | A1* | 4/2005 | Zukor | B01L 3/50825 34/443 |
| 2012/0102982 | A1* | 5/2012 | Zhou | A01N 1/0257 62/62 |
| 2012/0248057 | A1 | 10/2012 | Bogle et al. | |
| 2013/0205719 | A1* | 8/2013 | Wensley | B65B 3/003 53/408 |

FOREIGN PATENT DOCUMENTS

| | | | |
|---|---|---|---|
| CN | 104236290 | A | 12/2014 |
| DE | 2235483 | A1 | 1/1974 |
| GB | 1259039 | | 1/1972 |
| WO | 97/08503 | | 3/1997 |
| WO | 2006/013360 | A1 | 2/2006 |

* cited by examiner

METHOD AND DEVICE FOR OPTIMIZED FREEZE-DRYING OF A PHARMACEUTICAL PRODUCT

CROSS-REFERENCE TO RELATED APPLICATIONS

This application is a U.S. national phase application filed under 35 U.S.C. § 371 claiming benefit to International Patent Application No. PCT/IB2016/050559, filed Feb. 4, 2016, which is entitled to priority to Luxembourg Patent Application No. LU92648 filed Feb. 4, 2015, each of which is hereby incorporated herein by reference in its entirety.

BACKGROUND OF THE INVENTION

Field of the Invention

The present disclosure relates to a method and a device for optimized freeze-drying (lyophilization) of a pharmaceutical product.

Description of Related Art

Many substances, in particular in the medical, pharmaceutical and chemical field like for instance pharmaceutical products or medically and/or biologically active substances, are sealed in vessels, e.g. vials, for storage purposes. Typically, they require careful sealing in order to preserve their stability and their specific characteristics over a given time period. Moreover, many of these substances are extremely expensive, and many of them also require careful handling when they are being administered. Examples for the substances in question include, for instance, injection drugs that have been newly developed in recent years for treating or preventing intractable diseases, in addition to cancer controlling drugs, cancer inhibiting drugs and the like.

As mentioned above, in many of these substances, the stability of their medicinal efficacy during storage is critical. Accordingly, in many cases a method is employed in which, in order for the pharmaceutical ingredient in the substance, e.g. a drug, to be preserved both safely and stably over a long period, a freeze-dried pharmaceutical product is prepared by freeze-drying the drug with the pharmaceutical ingredient so as to change it into powder form. When the freeze-dried pharmaceutical product is to be administered to the patient, it is dissolved or suspended in a diluent (generically referred hereinafter simply as 'a diluent') so as to prepare an injection drug.

In general, vials (or other kinds of equivalent containers) may be used for the above-mentioned purpose of storing the freeze-dried pharmaceutical. During the freeze-drying processing, it is necessary to exchange gas between the inside and the outside of the cartridges. However, at times other than during freeze-drying processing, in order to secure the sterility of the interior of the vessel, the vessel should preferably be in a closed state which effectively prevents the injection drug or freeze-dried pharmaceutical product from coming into contact with the outside atmosphere. However, in common freeze drying processes as known so far from the state of the art vials are loaded into the freeze drier in the exchange state, i.e. with stoppers placed on the opening portions of the vials in a way that passages for enabling freeze drying are already present. To avoid contamination and to increase the safety of the process during the most critical stage, loading of vials into the freeze drier must be done under ISO 7 clean room conditions. Some companies have an automated loading system to avoid any direct contact of operators with the open product, but up to present day many companies load open product vials manually into the freeze dryer.

During freeze drying careful selection of the process parameters for the three steps in freeze drying, which are freezing, primary drying and secondary drying, is important to maintain the critical quality attributes of the drug and to enable an efficient process. With respect to the freezing stage in recent times numerous scientific papers have made plausible that avoiding random freezing in lyophilization processes may have positive effects. Supercooling causes product vials to freeze randomly at different temperatures. In consequence at the end of the freeze drying process vials of one batch may have different lyophilisate structures and thus different product qualities, i.e. the batch may be inhomogeneous. Different measures have been suggested to avoid supercooling during freezing and to initiate nucleation in all vials at the same time and temperature. Those methods are usually referred to as controlled nucleation.

After the freeze drying process the vials are closed by pushing the stopper, mostly made of an elastomeric material, into the neck of the vial. This closing procedure is mostly done by collapsing the shelves of the freeze drier together. The vials are ultimately sealed by enclosing the neck portion of the vial and the stopper by a metallic or polymeric wrapping. When an injection drug is to be administered to a patient, a diluent is suctioned into an empty syringe and subsequently injected therefrom through the syringe needle perforating the stopper into the vial. The freeze-dried pharmaceutical product is dissolved or suspended inside the vial, thereby creating the injection drug which may be suctioned back into the syringe and finally administered to a patient.

SUMMARY OF THE INVENTION

The method and the device according to various embodiments as disclosed herein may be used to increase the safety by avoiding contamination of pharmaceutical products such as parenteral pharmaceutical products during the most critical stage of loading of the liquid pharmaceutical preparation filled in vial containers into the freeze dryer. The method and the device according to various embodiments as disclosed herein may also be used to increase the quality of drug product by providing a superior method for performing controlled nucleation during freezing.

The method and the device according to various embodiments are preferably used in connection with vessels containing a pharmaceutical solution comprising an API (active pharmaceutical ingredient) which may be prepared for long-range storage by means of lyophilization. The term "vessel" may refer to any kind of vial, container, cartridge, syringe, bottle which is capable of storing a substance such as the API and may be used in vacuum conditions for the intended purpose of the method as disclosed herein. Thus, the terms vial, container, cartridge, syringe, or bottle can be used interchangeably for the term vessel.

In a basic underlying scenario, the vessel may be a glass vial or a polymeric vial and it may contain a pharmaceutical solution comprising any kind of API, such as a monoclonal antibody, an antibiotic or a chemotherapeutic agent, that is freeze-dried as is commonly known. The vessel may be equipped with a stopper as described above such that the vessel can be closed after it was filled with the pharmaceutical solution and is thus transported or transferred to the freeze dryer in a hermetically closed state. This closing is of importance to avoid contamination during the critical stage of loading of the vessel(s) into the freeze dryer. During the freeze drying process, the stopper of the kind as described above may be partly lifted from the neck of the vessel into the exchange state to facilitate a release of the sublimate of the pharmaceutical solution from the vessel. After the freeze drying processing step, the vessel is closed by mechanically pushing the stopper back into the closed state. The vessel may be then sealed by a metal crimp cap after unloading the closed vials from the freeze dryer. Alternatively the vessels can be closed and sealed within the freeze dryer by using a plastic device attached to each vessel.

In various embodiments, a method for lyophilizing a substance is provided, the method comprising the steps of: placing at least one vial containing the substance in a lyophilization chamber, the at least one vial having an opening in which a stopper is inserted in a closed state not allowing gas exchange between the interior and exterior of the vial; providing mechanical means external to the stopper and arranged above the opening for restricting an upward movement of the stopper; lowering the temperature within the lyophilization chamber to a predefined value below the standard freezing temperature of the substance and reducing the pressure within the lyophilization chamber to a predefined pressure, the predefined pressure being chosen such that the force exerted by it on the stopper lifts or moves the stopper from the closed state to an exchange state in which the stopper is only partly inserted in the opening of the vial allowing gas exchange between the interior and exterior of the vial, wherein the lowering of the temperature within the lyophilization chamber to the predefined value is performed before reducing the pressure within the lyophilization chamber to the predefined pressure.

The substance which may be lyophilized using the method for lyophilizing a substance may be any kind of substance, for example a liquid parenteral drug solution, such as a pharmaceutical solution based on a liquid or a slurry comprising an API, which is to be frozen and dried by means of sublimation.

After the vials containing the substance to be lyophilized have been transferred to the freeze drier in a closed state, the pressure within the freeze drier may be reduced to provide a relative overpressure within each vessel and by that to provide the force required to move the stopper from the closed state into the exchange state. In other words, the interior of the freeze drier needs to be evacuated to such an extent that the generated underpressure exerts enough force to overcome the static friction between the outer wall of the stopper and the inner wall of the opening portion of the vial. Even though the pressure value satisfying this requirement may be calculated, the exact pressure may still vary to some extent from vial to vial. When the difference between the static friction and the dynamic friction between the stopper and the neck portion of the vial is not equal for all vials, a situation may arise in common lyophilization processes in which after the static friction force has been overcome by the generated underpressure, the stopper gains enough momentum to pop out of and fall off the neck portion of a vial.

In order to provide a remedy for this unfavorable scenario, according to various embodiments of the method as disclosed herein mechanical means external to the stopper and arranged at the opening of the vial may be provided for restricting the upward movement of the stopper. The mechanical means external to the stopper may guarantee a well-defined end position for the travel of the stopper in which a predefined maximum portion of the stopper protrudes outwardly from the opening of the vial when it is in the exchange state and at the same time a predefined minimum portion of the stopper still remains inserted in the opening of the vial. In this context, the attribute "external to the stopper" with regard to the mechanical means may be understood as not depending on the interaction of the stopper with the vial and therefore providing a fail-proof means for defining the exchange state of the stopper. In other words, mechanical means external to the stopper pertain to mechanical means which are neither implemented in nor embodied by the vial and/or the stopper itself. Consequently, the mechanical means external to the stopper relate to a property of elements which are added to the vial-stopper compound system. Possible implementations of the mechanical means external to the stopper will be discussed further below. According to various embodiments, the opening in the vial may be provided in an upper neck portion of the vial. The mechanical means being arranged at the opening of the vial may include mechanical means which are generally arranged in the region of the opening of the vial, e.g. arranged on, above and/or around the opening portion of the vial.

The step of lowering of the temperature within the lyophilization chamber to the predefined value may be performed before reducing the pressure within the lyophilization chamber to the predefined pressure. In other words, before the evacuation process of the lyophilization chamber to lift the stoppers from the closed state to the exchange state is initiated, the temperature within the lyophilization chamber may be lowered to a temperature which lies below the standard freezing temperature of the substance. When the substance to be lyophilized is an aqueous solution (i.e. water based), the predefined value may lie below 0° C. and may, for example, correspond to −2° C., −5° C. or −10° C. or even lower. Therefore, the temperature of the substance may reach a temperature below the thermodynamic freezing temperature of the substance (e.g. a solution) with the substance remaining in a supercooled metastable liquid state until nucleation occurs at some nucleation temperature. In the context of this application, the thermodynamic freezing temperature denotes the "standard" freezing temperature of a solution without taking into account modifying effects such as supercooling. Thus, following that definition, water has a thermodynamic freezing temperature of 0° C.

According to various embodiments of the method, the mechanical means are configured to define a maximum portion of the stopper which can protrude outwardly from the opening of the vial in the exchange state. The mechanical means may be configured as securing means in order to guarantee a well-defined exchange state in which the stopper is partly extending from the opening and still partly remaining inserted in the opening.

According to a further embodiment, the method for lyophilizing a substance may further include initiating nucleation in the substance within the at least one vial by lifting the stopper from the closed state, thereby abruptly lowering the pressure within the vial. The term nucleation relates to the formation of a new thermodynamic phase and in this case may relate to the transition of the solution or components thereof from liquid phase, e.g. a metastable supercooled state, to solid phase. This process may take place rather abruptly, comparable to the seemingly instantaneous formation (nucleation) of ice in undercooled water. By lifting the stopper from the closed state, a pressure drop is induced within the corresponding vial leading to adiabatic cooling of the gas above the liquid phase. Upon adiabatic cooling, the saturation concentration of water vapor above the liquid decreases and consequently water gas is condensing to very small droplets or ice crystals which may act as crystallization nuclei for the liquid triggering nucleation. Provided that the pressure drop has a least a predefined magnitude and that the temperature within the lyophilization chamber is at a predefined value or lower, the adiabatic cooling by abrupt lowering of the pressure within the vial may induce nucleation within the solution, i.e. the substance to be lyophilized. Therefore the lifting of the stopper from the closed state into the exchange state may be seen as a trigger which induces the thermodynamic transition. In other words, the nucleation according to this embodiment of the method may be referred to as controlled nucleation since it may be triggered by the event of the stopper being lifted from the corresponding vial, which in turn may be controlled by lowering the pressure within the lyophilization chamber to a predefined value or below a predefined threshold in order to lift the stopper from the closed state.

It is important to realize that in the context of this application the nucleation, i.e. the formation of nucleation sites which initiates freezing of the substance to be lyophilized, is triggered by the lifting of the stoppers from the closed state, i.e. by the pressure drop. The substance to be lyophilized remains in a 100% liquid state during and after the temperature has been lowered to the predefined value, possibly in a metastable supercooled state, without any initial freezing processes taking place. The pressure drop induced by the stopper being lifted from the closed state into the exchange state provides the only nucleation trigger. Other nucleation triggers such as dust in the lyophilizing chamber and/or impurities in the substance may not be present, especially in cases where the substance contains an API and, by medical standards, corresponds to a highly purified solution which is thus lyophilized in an ultra-pure environment. Overall it is important to realize that the freezing of the substance according to the method of the present application does not correspond to classical freezing induced by lowering the temperature within the lyophilizing chamber below the freezing temperature of the substance and waiting for the ensemble of vials to freeze in a random and chaotic process based on nucleation sites already present in the vials. According to the present invention, the lowering of the temperature within the lyophilization chamber to a predefined value below the freezing temperature of the substance takes place without (initial or any kind of) solidification of the substance. In the absence of the controlled pressure drop in each vial, the substance contained therein would not freeze at all. The predefined value of the temperature needs to be below the eutectic temperature in order to enable triggered nucleation by means of lifting the stopper. The exact predefined value of the temperature may be determined experimentally by exposing the substance to be lyophilized to a temperature a few degrees below the eutectic temperature and observing over a prolonged period, e.g. a few hours, e.g. 3 h, 6 h, 12 h or 24 h or even more hours, whether "spontaneous" freezing takes place. If it does, the same process may be repeated with a slightly increased temperature value, e.g. by half a degree centigrade or by one degree centigrade. If, on the other hand, it does not, the temperature value may be used in the lyophilization process as the predefined value in order to determine whether it is low enough for the freezing process to be reliably initiated by the pressure drop as nucleation site. The whole testing procedure, i.e. the exposing of the substance to a test predefined value of the temperature and the subsequent use of that predefined value in the actual lyophilizing process may be performed with respect to a batch of samples to gain statistical verification of the reliability of the tested temperature value.

The pressure within the vial is thereby abruptly lowered when the stopper is lifted from the closed state and the atmosphere above the solution within the vial is promptly over-saturated with water gas leading to (ice) fog formation which provides nucleation seeds for reliable nucleation within the solution. The method according to various embodiments as described herein may have the following advantages over prior art methods:

i) Nucleation is triggered by the event of the stopper being lifted from the corresponding vial and takes place in each vial separately. As the gas volume of a vial is much less than the volume of the lyophilization chamber, the solvent vapour saturation of the gas atmosphere above the solution is reliably in an equilibration state. The extremely high rate of pressure loss by promptly lifting the stopper ensures adiabatic cooling with generation of the (ice) fog. The pressure drop rates achievable by the method according to various embodiments cannot be technically realized by reducing the pressure by vacuum pumps or valve opening to vent a pressurized chamber.

ii) Nucleation takes place at relative low pressure difference and does not require low chamber vacuum. Therefore dissolved gases in the solution do not bubble up significantly which could lead to undesirable foamlike lyophilisate-cake appearance.

iii) The implementation of the method according to various embodiments does not require any modification of the freeze dryer nor any additional equipment to be added to the freeze dryer.

According to a further embodiment of the method for lyophilizing a substance, the external mechanical means may be configured to prevent the stopper from falling off the opening or the opening portion of the at least one vial when stopper is lifted from the closed state. In other words, the external mechanical means may be configured to restrict the free space into which the stopper may advance when it is moved from the closed state into the exchange state, for example the free space above the neck of the vial, in such a way that the stopper remains seated on the vial, for example on the neck portion of the vial.

According to a further embodiment of the method for lyophilizing a substance, providing the mechanical means external to the stopper for restricting the upward movement of the stopper may include positioning of shelves within the lyophilization chamber at a predefined distance from each other. In other words, providing the mechanical means external to the stopper may include positioning of a motor- or hydraulic driven shelf within the lyophilization chamber above the at least one vial at a predefined distance therefrom. In the context of the method and device described herein, restricting the movement of the stopper refers to the process of allowing movement of the stopper up to a certain predefined degree, i.e. by a predefined distance. The predefined distance may be chosen such that the stopper is prevented from rising from the neck portion of the at least one vial beyond the exchange state by positioning the shelf above this said vial to restrict the protrusion of the stopper, such that the distance between the opening of the vial and the underside of the shelf is preferably equal to or smaller than the height of the stopper, i.e. the size of the stopper along the axis along which it moves when transitioning from the closed state to the exchange state (or equivalently vice versa). The shelving plate may refer to a plate within the lyophilization chamber which may be used as temperature setting means within the lyophilization chamber, i.e. it may be cooled or heated in order to draw heat from or provide heat to the inside of the lyophilization chamber and by that to draw heat from or provide heat to vessels loaded onto said shelf which are filled with substances to be freeze dried. The exchange state may refer to a well-defined state in which the stopper is only partly protruding from the neck portion of the vessel thereby allowing gas exchange between the inside and outside of the vessel.

According to a further embodiment of the method for lyophilizing a substance, providing the mechanical means external to the stopper for restricting the upward movement of the stopper may include providing a closure device on the neck of the vial which encloses a space above the opening of the vial, thereby being configured to restrict the upward travel of the stopper when it is lifted from the closed state into the exchange state. The closure device may be a vial crimp sealing device or a cap-like sealing device which may be used in order to secure the stopper in place after it has been pushed down into the neck portion of the vessel and has taken the closed state. The closure device may be configured as a one-way closure device meaning that once it has been actuated to secure the stopper, opening the closure device entails its destruction such that it cannot be used a second time. In a sense, the closure device also acts as a safety closure, its integrity indicating intactness of the hermetic seal of the vessel and—provided the substance has not yet expired—its safe usability. The closure device may be configured such that when placed on the neck portion of the vessel, it provides just enough space above the opening in the neck portion of the vessel for the stopper to be able to transition into the exchange state. In order to ultimately seal the vessel after the freeze drying process is finished, depending on the form of the closure device, pressure may be applied from the top and/or laterally to the closure device to form a tight seal around the stopper and the neck portion of the vessel. A closure device as referred to herein which may be generally used for the purpose of ultimately securing the stopper in its sealing state is for example disclosed, in the U.S. Pat. No. 8,225,949 B2. However, in order for that closure device to provide the functionality as required by the closure device according to this description, the dimensions of at least some of its components may have to be adjusted such that when the closure device is placed on a neck portion of a vial, there is enough space for the stopper to be move into when it is lifted from the closed state and transitions into the exchange state. More specifically, when the closure device as exemplarily disclosed in U.S. Pat. No. 8,225,949 B2 is placed on the neck portion of a vial, the vertical dimension of the hollow space enclosed by the closure device above the neck portion of the vial has to be large enough to allow the stopper to protrude from the neck portion of the vial in the exchange state just enough to provide gas exchange between the interior and exterior of the vial.

According to a further embodiment, the method for lyophilizing a substance may include forcing the stopper into and securing it in the closed state after the lyophilization process by pressing the closure device onto the neck of the vial. During that step, either the closure device itself may be slightly deformed to form a tight seal around the neck portion of the vial or the force exerted on the closure device may activate a mechanical latching function which tightly seals the vial by a cap which is provided within the closure device, for example as described in the U.S. Pat. No. 8,225,949 B2.

According to a further embodiment of the method for lyophilizing a substance, providing the mechanical means external to the stopper for restricting the upward movement of the stopper may include placing the at least one vial into the lyophilization chamber in a tray package having a container and a lid, the lid movably supported at a predefined distance from the container, the lid being configured to restrict the upward travel of the stopper when it transitions from the closed state into the exchange state. The tray package may further include a nest in which the vials to be processed in the lyophilization chamber may be placed.

According to a further embodiment of the method for lyophilizing a substance, the predefined pressure may correspond to a pressure value of 800 mbar or less and may generally lie in the range between a few tens of mbar and a few hundreds of mbar. For example, the predefined pressure may correspond to a pressure value between approximately the vapour pressure of the solution to be freeze dried and approximately 800 mbar. In general, the predefined pressure may lie in the range between approximately the vapour pressure of the solution to be freeze dried and approximately 500 mbar, e.g. in the range between approximately the vapour pressure of the solution to be freeze dried and approximately 250 mbar. One of the factors which may need to be considered when choosing an appropriate value of the predefined pressure is the force which is needed to lift the stopper from the closed position into the exchange position. A further factor which may need to be considered when choosing an appropriate predefined pressure is the precondition that boiling of the solution to be freeze drying must be strictly avoided at the specific temperature level the lyophilization chamber has been set to.

In various further embodiments a tray package for holding the vials is provided, the tray package comprising: a container, a holding element positioned within the container and having at least one opening therein for holding a vial, a lid movably supported at a predefined distance from the container. The tray package may be configured to hold nests for vials and thus enable the processing of nested vials.

According to a further embodiment of the tray package, the lid may be movable in a downward direction from its quiescent position in a reversible manner by means of dynamic elements which may be used to support the lid. The quiescent position corresponds to the position of the lid when no other force is acting on the lid and on the dynamic elements other than the weight force of the lid. From this quiescent position, the lid can be moved towards the container (i.e. downwards), e.g. by applying a force in the direction towards the container. In other words, the lid may be pushed or pulled down, the pushing or pulling force ultimately acting on the dynamic elements. In one group of embodiments of the tray package, the lowering of the lid may be a reversible process and may be provided by elasticity (reversible deformation) of the dynamic elements which return to their initial form and/or position defined by the quiescent position of the lid as soon as the force causing the downward movement of the lid is removed. Any one of elements from a group of elements comprising springs, elastic O-rings, rubber bands and flexible cylinders can be used as a dynamic element. However, in a further group of embodiments of the tray package instead of elastic dynamic elements equivalent mechanical elements such as lift systems, for example based on pulley constructions, may be used instead. Those mechanical elements may be passive or active. Passive mechanical elements may be seen as equivalents to the plastic dynamic elements and be configured to allow reversible lowering of the lid. Active mechanical elements may include motors and/or actuators, such as piezoelectric stepper motors, in order to autonomously lower the lid towards the container without external pushing force from the shelving plate. The use of active mechanical elements as dynamic elements may be especially useful with old lyophilization chambers in which it is not possible to move the shelving plate. Those old lyophilization chambers may be still used for the method for lyophilizing a substance according to various embodiments by substituting the missing movable shelving plate within the lyophilization chamber with the lid which may be actively pulled towards the container by active mechanical elements. Put in other words, the operation of a tray package using active mechanical elements does not rely on a movable shelving plate inside the lyophilization chamber. In a yet further group of embodiments of the tray package the dynamic elements may be plastic, i.e. irreversibly deformable, such that they allow irreversible lowering of the lid towards the container. This kind of dynamic elements may be used as cheap one-way dynamic elements which have to be replaced after every single use of the tray package in a lyophilizing process. Put generally, the dynamic elements may be understood as elements which allow lowering of the lid towards the container, actively or passively, in a reversible manner or in an irreversible manner. The dynamic elements may, for example, be arranged at corner positions of the container or along its sides, e.g. in the middle of each of the sides.

The tray package may be especially useful in combination with freeze driers in which the distance between each shelf cannot be set to a desired value, i.e. cannot be adjusted infinitely upper shelving plate can be lowered to one specific position only but in which it is not possible to arbitrarily adjust the position of an upper shelving plate. Usually, the one specific position may be defined such that when the upper shelving plate is lowered to the one specific position, it presses on the stoppers of the respective vials, thereby sealing the vials. However, in order to prevent a stopper from popping out of and falling off a neck portion of a vial would require the upper shelving plate to take a position in which it is arranged slightly farther away from the upper edges or rims of the vials arranged in the lyophilization chamber. The nested package as disclosed herein may come into play when this is not possible. The dynamic elements of the tray package may be configured to hold the lid above the container such that, figuratively speaking, it acts as a ceiling (or the non-existed upper shelving plate of the lyophilizer lowered to an appropriate level) against which a stopper that would otherwise pop out of and fall off the neck portion of the vial can bump, thereby remaining at least partly seated in the neck portion of the vial. Therefore, the tray package may be configured such that the distance between the opening of the at least one vial and the inner surface of the lid which is facing the vial is less than the height of the stopper, i.e. its size along the axis along which it moves when transitioning from the closed state to the exchange state (or equivalently vice versa). The tray package may be configured such that, when a vial with a stopper has been placed in the tray and the removable lid has been arranged above the container, e.g. supported by the dynamic elements, the distance between the upper surface of the stopper (i.e. the surface facing away from the vial in which the stopper is inserted) and the surface of the lid facing the vial (hereinafter: inner surface of the lid), the lid being in its quiescent position, is approximately equal to or less than 15 mm, e.g. approximately equal to or less than 10 mm, e.g. approximately equal to or less than 5 mm. In further embodiments the lid may comprise protrusions provided on the inner surface of the lid which may be provided in order to adjust or fine tune the distance by which the stopper may travel upwards. The protrusions may be provided in regions of the inner surface of the lid which are arranged above stoppers of the vials once the vials have been placed in the container of the nested package.

The plasticity (e.g. reversibility ensuring elasticity or just one-way deformability) of the dynamic elements supporting the lid ensures that the lid is movable towards the container and thus the stopper of the at least one vial may be pushed into the neck portion thereby transitioning from the exchange state into the closed state after the freeze-drying process is finished. This may be performed by collapsing the shelving plates within the freeze drier together, for example by means of hydraulic pressure. The shelving plate then pushes down on the lid and ultimately on the dynamic elements which yield to this force such that the lid is moved downwards, comes in contact with the upper surface of the stopper (if not already the case) and pushes the stopper into the neck portion of the vial thereby closing the vial.

According to a further embodiment the tray package may further include at least one guiding element which is configured to restrict motion of the lid with respect to the container to a uniaxial motion. The at least one guiding element may eliminate the effect of forces which do not act on the lid in a perpendicular direction with respect to its surface and hence may exert a shear force on the at least one stopper during the process of pushing the stopper into the neck portion of the vial to achieve closing of the vial. The at least one guiding element may avoid such situations and may assure that the axis of motion along which the stopper is to move within the neck portion (movement between closing state and exchange state) by design and the axis along which the center of mass of the lid moves towards the container during the process of closing the vial with the stopper are aligned. The at least one guiding element may, for example, be configured as a rod or a bar extending from the lid of the tray package into an opening provided in the container which restricts the relative motion between the container and the lid to a motion which takes place along an axis which runs longitudinally through the opening in the container and/or the rod. In some embodiments, the at least one guiding element and the at least one spacer element may be provided as one element.

DETAILED DESCRIPTION OF THE INVENTION

Hereinafter, embodiments of the present invention will be described in detail with reference to the accompanying drawings.

Figure 1:
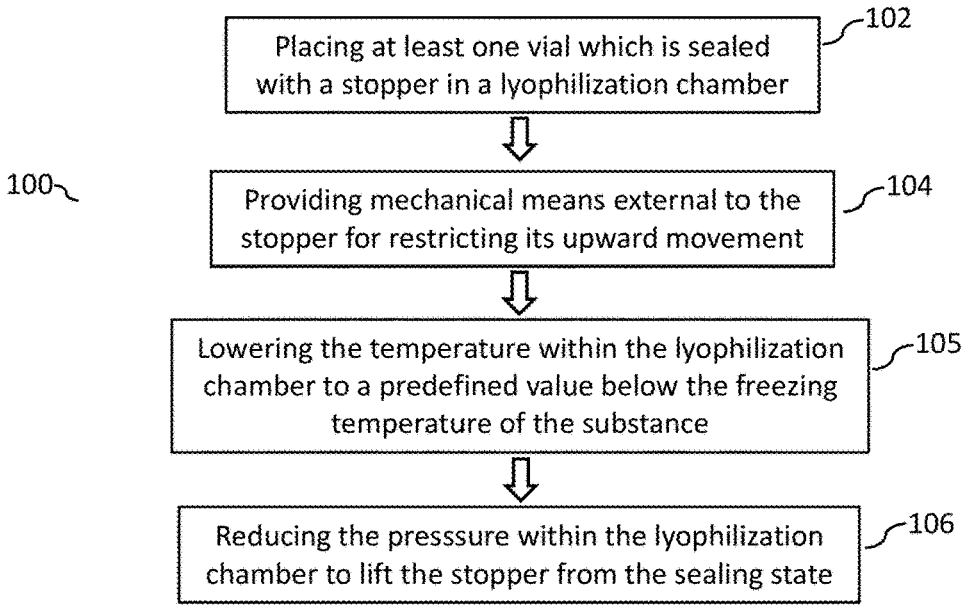
FIG. 1 is a flow chart depicting the method for lyophilizing a substance according to an embodiment of the present invention.

FIG. 1 shows a flow chart 100 depicting the method for lyophilizing a substance according to an embodiment of the present invention in its basic implementation. In a first step 102, the method according to various embodiments may include placing at least one vial containing the substance—i.e. the substance to be lyophilized—in a lyophilization chamber, the at least one vial having an opening which is closed by a stopper. In other words, the stopper is in the closed state not allowing gas exchange between the interior and exterior of the vial. In a next step 104, the method may include providing the mechanical means external to the stopper and arranged at the opening of the vial for restricting an upward movement of the stopper. It is to be noted that step 104 may carried out prior to step 102, e.g. if the tray package with the lid is used as mechanical means external to the stopper to secure the stopper in the exchange state. In that case, the at least one vial may be placed in the tray package before the tray package is then placed in the lyophilization chamber. If, on the contrary, the movable shelving plate within a lyophilizer is used as mechanical means external to the stopper to secure the stopper in the exchange state, the shelving plate may be lowered to its predefined position above the at least one vial and thereby fulfill the role of the mechanical means external to the stopper after the at least one vial has been placed in the lyophilization chamber. Thus, the actual chronological order of step 102 and step 104 is irrelevant from the point of view of the inventive concept and is rather determined by practicality. The method according to various embodiments as depicted in FIG. 1 relies on the mechanical means external to the stopper being in place before step 106 is performed. However, prior to step 106, in step 105 the temperature within the lyophilization chamber is lowered to a predefined value below the freezing temperature of the substance. This step may be advantageously performed before the following step 106 in which the pressure within the lyophilization chamber is reduced to a predefined pressure, the predefined pressure being chosen such that the force exerted by it on the stopper is capable of lifting the stopper from the closed state to the exchange state. In the exchange state, the stopper is only partly inserted in the opening of the vial allowing gas exchange between the interior and exterior of the vial. As can be realized, the chronological order of step 102 and step 104 depends on the actual implementation of the mechanical means external to the stopper. The inventive concept embodied by the method as explained may be seen to rely on the mechanical means external to the stopper being fully operational before the stopper of the at least one vial can be lifted from the closed state into the exchange state by underpressure (or, put differently, by a relative overpressure present within the closed vial).

The method disclosed herein may be particularly advantageous in the sense that it is designed for vials which may be placed in a freeze drier in a closed state, i.e. in a state in which the stopper is preventing gas exchange between the interior and the exterior of the vials. This may be advantageous since the vials may be transported into the freeze drier in the closed state, i.e. safely preventing contamination of the interior of the vial. Once the freeze drier is closed, the vials may opened by lowering the pressure within the freeze drier.

Figure 2:
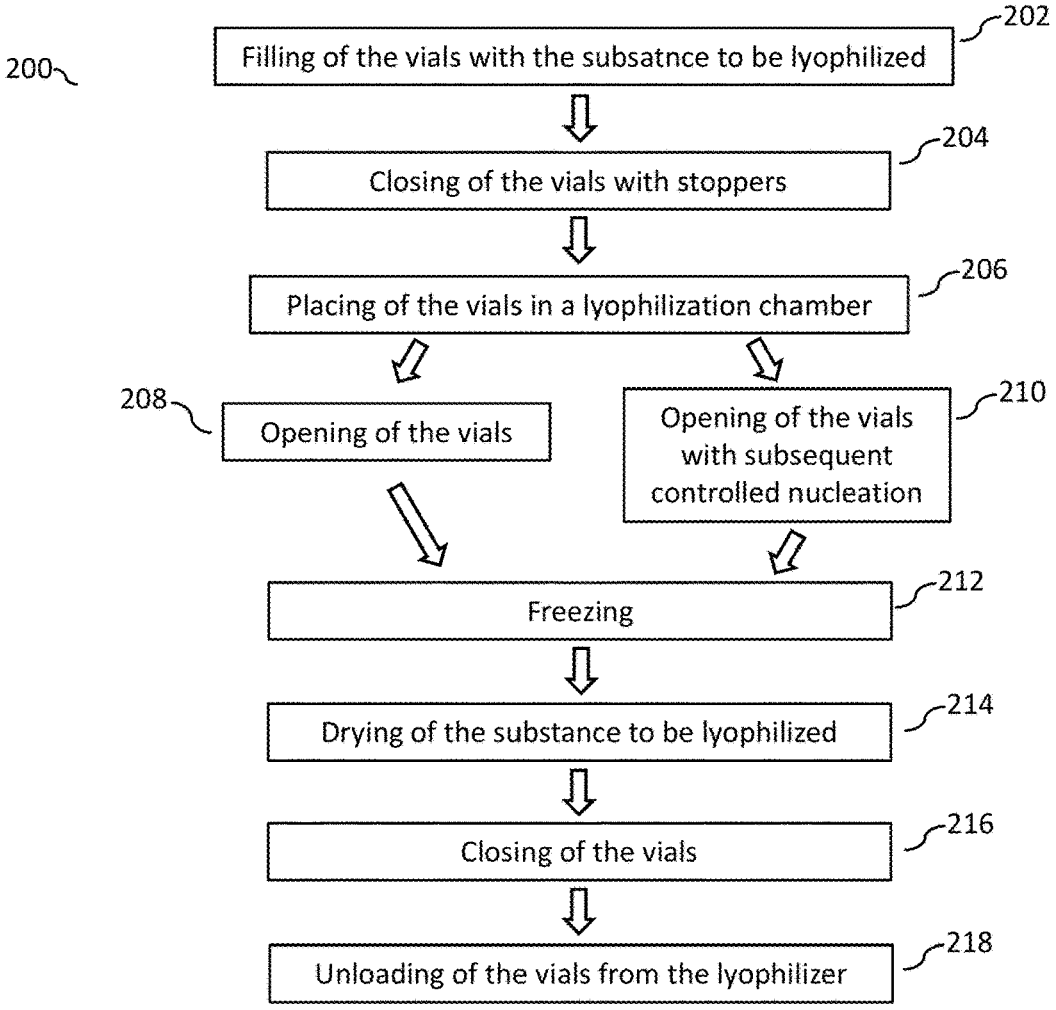
FIG. 2 is a flow chart describing a process of preparing a pharmaceutical substance which includes the method for lyophilizing a substance according to an embodiment of the present invention.

A further embodiment of the method for lyophilizing is depicted in the flow chart 200 shown in FIG. 2 in a more extended form. The flow chart 200 depicts a process which may be applied in order to prepare a pharmaceutical substance which includes the method for lyophilizing a substance according to various embodiments of the invention. In the following, the method for lyophilizing as outlined in the flow chart 200 will be described on the basis of a number of vials assuming a highly industrialized process. However, it is to be understood that the process as such is applicable to a single vial as well and does not rely on the presence of a multitude of vials.

The method for lyophilizing a substance according to various embodiments may begin with step 202 in which the vials are filled with the substance to be lyophilized. The filling may be performed according to a standard liquid filling line using an isolator or a reduced access barrier system (RABS).

In a next step 204, each of the vials may be closed with a stopper. The closing process may directly follow the filling process such that the risk of contamination of the substance inside the vials is minimized. A vial may be closed by pushing the corresponding stopper into the neck portion of the vial such that there is no gas exchange between the interior and the exterior of the vial.

After the filling process is finished, the vials may be placed in a lyophilization chamber in step 206. In addition, as an optional step, a closure device of the kind described above may be attached to or placed on the neck portion of the closed vial. If the closure device is designed appropriately as discussed above, then placing the closure device on each vial may be seen as providing mechanical means external to the stopper and arranged at the opening of a vial for restricting an upward movement of the stopper. The closure device may be placed on the vials either immediately after filling or at any subsequent time prior to placing the vials in the lyophilization chamber. Since the vials are closed when they are extracted from the filling line, their transfer to the lyophilization chamber is less critical under the aspect of sterility. Several possibilities exist for placing the vials in the lyophilization chamber. In one embodiment, the vials may be placed in standard loading systems as known from state of the art in the form of racks, e.g. steel racks, before being placed in the freeze drier to improve their handling. In another embodiment, the vials may have already been placed in a special holding container, such as a container of a tray package according to various embodiments, before being filled with a substance to be lyophilized in the filling line. A tray package according to various embodiments may allow the vials to remain therein during the entire filling process and subsequently during the entire freeze-drying process. In addition, the tray package according to various embodiments may include a movably supported lid which may be seen to correspond to the mechanical means external to the stopper and arranged above the opening of a vial for restricting an upward movement of the stopper. The movably supported lid may be attached to the container of the tray package at a distance therefrom at any time. In yet another embodiment that may be used to restrict the movement of the stoppers when the vials are opened via vacuum in the freeze drier the vials may be placed in a rack inside the freeze drier and the distance between the shelves or shelving plates within the freeze drier may be adjusted to define a maximum travel by which the stoppers may be lifted from the vials. This option, however, is only viable if the freeze drier offers this specific functionality.

After the freeze drier has been loaded with the filled and closed vials, there are generally two different freezing patterns which may be applied in order to transform the previously liquid substance into a solid lyophilisate.

First, step 208 will be described which comprises opening of the vials by underpressure. Here, the chamber of the freeze drier is evacuated down to a pressure which exerts enough force to pull the stoppers which close the vials into their exchange states. Optionally the temperature of the freeze dryer may be lowered to a temperature above the thermodynamic freezing temperature of the substance before evacuation, for example to a temperature between approximately 5° C. and 10° C. above the thermodynamic freezing temperature of the substance. By doing so situations may be prevented in which the substance boils which would lead to a highly inhomogeneous ice structure within the frozen substance. This step may also prevent boiling of the substance during the subsequent steps.

After all stoppers have taken their exchange positions (which may take a certain time since the opening time of a vial is a stochastic process), the temperature within the freeze drier may be lowered to a freezing temperature well below the thermodynamic freezing temperature and well below the glass transition temperature, e.g. to −45° C. for aqueous solutions, in order to induce conventional freezing of the substance to be lyophilized in step 212. Since the temperature at which the supercooled solution contained in a vial spontaneously forms ice is a randomly distributed parameter, the substance in each of the vials freezes at a different temperature in the freezing step 212 and hence at a different point in time. Due to the stochastic spread of the nucleation temperatures, choosing the freezing temperature to lie well below the standard freezing temperature of the substance to be lyophilized is essential in order to eventually obtain frozen lyophilisate in each of the vials.

The random distribution of nucleation temperatures may cause the content of each vial to nucleate at a different temperature which may result in different ice crystal structure, prolonged drying time and batch inhomogeneity. However, independent of those circumstances, after the vials have been exposed to a temperature well below the standard freezing temperature of the lyophilisate for a certain time, at the end of step 208 the substances to be lyophilized in all vials are frozen and ready for the next stage in the lyophilization process.

As an alternative to step 208, step 210 may be executed after the vials with stoppers in stealing state have been placed in the lyophilization chamber in step 206. In step 210, the order of lowering the temperature and opening of the vials is reversed as compared to step 208. In step 210, before opening the vials by underpressure, the temperature within the lyophilization chamber is lowered to a temperature slightly below the standard freezing temperature of the lyophilisate, for example to −5° C. or −10° C. for aqueous solutions. As can be seen, this temperature is significantly higher that the temperature which is set in the lyophilization chamber in step 208. Due to the high purity of the solution, it remains liquid in a supercooled state in each vial, even though that temperature is chosen to lie below the standard freezing temperature of the solution. The vials may be left to rest at that temperature until they are all equilibrated at that same temperature. Next, the pressure in the lyophilization chamber is lowered to a predefined value, e.g. to 200 mbar. One of the factors defining the predefined pressure value may be the force required to move the stoppers from their closed state into the exchange state. Even though the pressure required for this to happen may be calculated, the actual pressure at which a respective stopper pops out of the vial into the exchange state is subject to stochastic variations. In other words, the time it takes for each vial to be opened is randomly distributed and, depending on the size of the batch of processed vials, may last anything from a few minutes to a few tens of minutes.

Once a vial is opened by the stopper moving to the exchange state, the pressure inside the vial drops abruptly to the predefined value prevailing in the lyophilization chamber. This sudden drop of pressure which may be assumed to be on the order of the ambient pressure minus the predefined pressure prevailing in the lyophilization chamber acts as a nucleation impulse and thus triggers nucleation in the substance to be lyophilized, i.e. the formation of nucleation seeds from fog formation in the atmosphere above the solution within the vial due to over-saturation. Still, it cannot be predicted when a respective vial is opened and consequently when the subsequent formation of ice in a respective vial takes place. The fundamental difference to step 208 is, however, that the nucleation in each of the vials takes place at the same precisely defined temperature, namely the temperature which is prevailing in the lyophilization chamber (e.g. for aqueous solutions the temperature of −5° C. or −10° C. mentioned above) and at which all of the vials have equilibrated. The advantage of this mode of operation may be seen in that the content in each vial nucleates at the same relatively high temperature i.e. slightly below the thermodynamic freezing point of the substance. In other words, independent of the point in time at which the nucleation in a respective vial may take place, the nucleation process in step 210 always takes place at the temperature prevailing in the lyophilization chamber. In that sense, the nucleation in step 210 may be seen to take place in a controllable manner. The advantages of controlled nucleation in respect to product quality, batch uniformity, process time and process cost saving are well described in the literature, for example in "Controlled ice nucleation in the field of freeze-drying: Fundamentals and technology review by R. Geidobler and G. Winter in European Journal of Pharmaceutics and Biopharmaceutics 85 (2013), pages 214-222.

Independent of the actual implementation of the step in which the vials are opened by means of underpressure, i.e. either according to step 208 or step 210, in each of those steps the mechanical means external to the stopper and arranged at the openings of the vials for restricting an upward movement of the stopper may be applied or may become effective in order to prevent the stoppers from "popping out" too far from the vial and falling off the vial. When the mechanical means are applied, it may be guaranteed that the stopper will not fall off the neck portion of the vial.

Independently of the actual implementation of the opening process of the vials (i.e. conventional opening according to step 208 or opening with controlled nucleation according to step 210), subsequently the freezing step 212 is performed. The freezing process in step 212 is a conventional thermodynamic process in which the substance transitions from liquid phase into solid phase.

After the drying step 214 which is performed after the freezing step 212, the frozen and dried lyophilisate, i.e. the end product, is enclosed within the vial in step 216 by pushing the stopper from the exchange state into the closed state. This may be performed by lowering a shelving plate within the freeze drier towards the neck portions of the vials just enough to push the stoppers back into the necks of the vials such that they take the closed state again. It is to be noted that the lowering of a movable shelving plate within the lyophilization chamber works in combination with any of the mentioned means external to the stopper and arranged at the openings of the vials for restricting an upward movement of the stoppers. In the case of the movable shelving plate itself fulfilling the role of the external mechanical means, the shelving plate may be trivially just lowered further until the stoppers have reached their final state (closed state). In the case of the closure device being provided on the neck of each vial, the shelving plate may exert a pushing force on the closure device which in turn pushes down on the stopper. In the last case of the lid of the tray package according to various embodiments fulfilling the role of the eternal mechanical means, the shelving plate is lowered and exerts a pushing force on the lid which in turn exerts a force on the stoppers. The tray package and its use will be described in more detail below.

In the last step 218 of the method depicted in the flowchart 200, the vials can be unloaded from the freeze drier. Since the vials are hermetically closed, the risk of contaminating the end product is eliminated.

In the state of the art, a lyophilization method is known in which a lyophilization chamber is first pressurized, for example to a pressure of approximately 2 bar, and then a ventilation valve is opened to abruptly reduce the pressure in the lyophilization chamber to induce nucleation in the materials to be lyophilized. In other words, this method relies on a buildup of overpressure which is quickly released to generate a strong pressure drop which acts as nucleation trigger. However, in order to apply this method, a common lyophilization apparatus has to be fitted subsequently with the ventilation valve and an extra input which may be used to pressurize the lyophilization chamber. Both measures are time consuming and incur costs.

The method for lyophilizing a substance according to various embodiments can be applied without pressuring the chamber. As has been described with regard to step 210, the pressure drop is generated by the sudden transition of the stopper from the closed state to the exchange state. This transition takes place practically instantaneously and thus generates a steep pressure drop inside the vial, wherein the pressure drop rate is given by the difference of the pressure within the vial (e.g. approximately 1 bar) and the pressure within the lyophilization chamber (e.g. 100 mbar or e.g. 200 mbar) at the point of vial opening, divided by the time need for reaching this state. The opening of the closed vial which is practically an instantaneous process may be safely assumed to take place on a timescale of less than a second, e.g. between a few tens of milliseconds and a few hundreds of milliseconds. In other words, in the method for lyophilizing a substance as disclosed herein the nucleation process is controlled or initiated locally, i.e. by an event that affects each vial individually and independently, namely the lifting of a stopper to the exchange state in a respective vial resulting in extremely high pressure drop rates due to spontaneous opening of single each single vial. The solvent vapour saturation of the gas atmosphere above the solution of each closed vial is reliably in an equilibration state. The extremely high rate of pressure loss by promptly lifting the stopper ensures adiabatic cooling with generation of the ice fog providing instantly nucleation seeds for initiating freezing which spreads from the surface of the solution into the solution. In contrast thereto, in the method known from the state of the art, the nucleation is initiated by a global event, i.e. simultaneously for the whole batch of vials, by venting the lyophilization chamber which results in much lower pressure drop rates due to principal technical limitations and therefore to less reliable adiabatic cooling.

A further advantage may be seen in the fact that common lyophilization devices may be used to perform the method disclosed herein without any costly and time consuming upgrades or modifications. A yet further advantage may be seen in the fact that the venting of the vials takes place in a hermetically sealed and sterilized environment (i.e. the lyophilization chamber). Therefore, neither can the content of the vials be contaminated with pollutants from outside of the lyophilization chamber, nor can toxic evaporates from the vials contaminate the ambient air outside of the lyophilization chamber, e.g. the space surrounding the clean-room area.

As mentioned above, in order to perform the method for lyophilizing a substance as described herein with a high success rate, the stoppers need to be pushed back into the closed state after the vials have been freeze dried. As already outlined above, various kinds of mechanical means external to the stopper and arranged at the opening for restricting an upward movement of the stopper may be provided to prevent the stoppers falling off the neck or neck portions of the vials.

Figure 3:
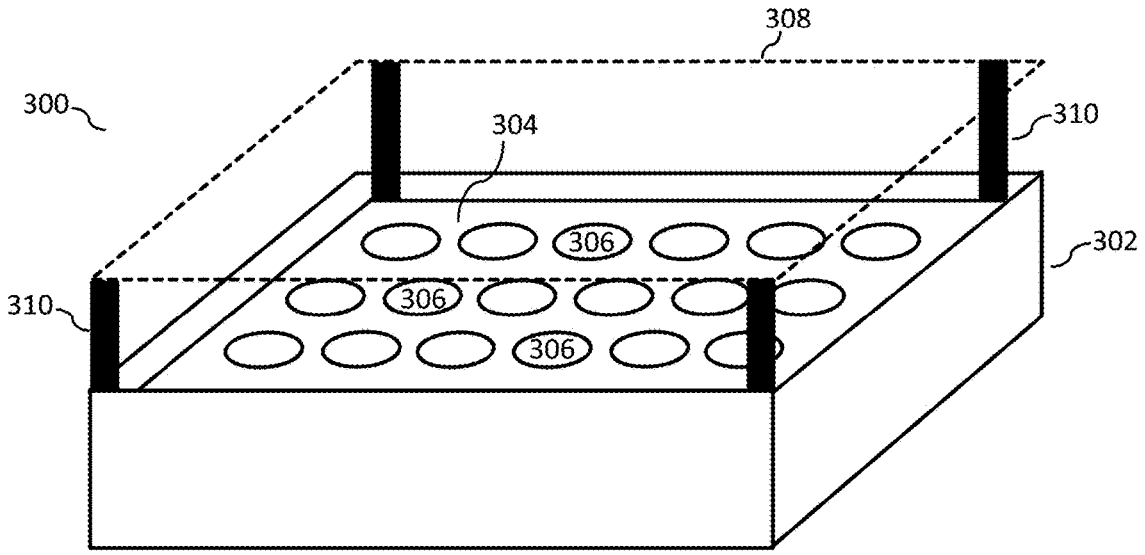
FIG. 3 is a perspective side view showing an empty tray package according to an embodiment of the present invention.

In FIG. 3, the tray package 300 according to various embodiments is shown which includes the mechanical means external to the stopper. The tray package 300 includes a container 302, a holding element 304 arranged within the container 302 and having at least one opening 306 therein for holding a vial. The holding element 304 may be configured as a tray with openings 306 for accommodating vials such that the vials may processed and/or safely transported without the risk of bumping against each other and breaking. The form/diameter of the openings 306 may be adapted to the form of the vials to be placed therein. The tray package 300 further includes a lid or a cover 308 which is movably supported at a predefined distance from the container 302. In FIG. 2, the lid 308 is indicated as a seemingly transparent parallelogram with a dashed contour in order to be able to show the structure of the tray package 300 that would in real life would be obscured by the lid 308.

The tray package 300 may further include at least one dynamic element 310 which may be configured to enable movement of the lid 308. In some embodiments of the tray package 300 according to various embodiments, the at least one dynamic element 310 may be a deformable element such as a rubber cylinder or a spring. The deformable element may be one that deforms elastically, i.e. reversibly, or plastically, i.e. irreversibly. In FIG. 3, four dynamic elements 310 are shown (only two of the four carrying the corresponding label), each arranged in a corner of the container 302. Even though this configuration may be mechanically favorable, other configurations in which, for example, a dynamic element 310 is provided somewhere, e.g. in the middle, of each of the four sides of the container 302 are conceivable as well. The lid 308 and/or the dynamic elements 310 are configured such that in the quiescent position the distance between the inner surface of the lid 308 and the container 302 is such that the stoppers from vials (not shown in FIG. 3) placed in the container 302 cannot be completely lifted from the necks or neck portions of the vials and fall off. This aspect will be described in more detail with reference to the next figure. In further embodiments, the dynamic elements 310 may be configured as adjustable mechanical means which provide movability to the lid 308 by passive or active adjustment without being deformed. For example, at least one of the dynamic elements 310 may be configured as motor based (active) lifting device and the remaining dynamic elements 310 may be configured as passive lifting devices which act passively based on the action of the motor based (active) lifting device.

Figure 4:
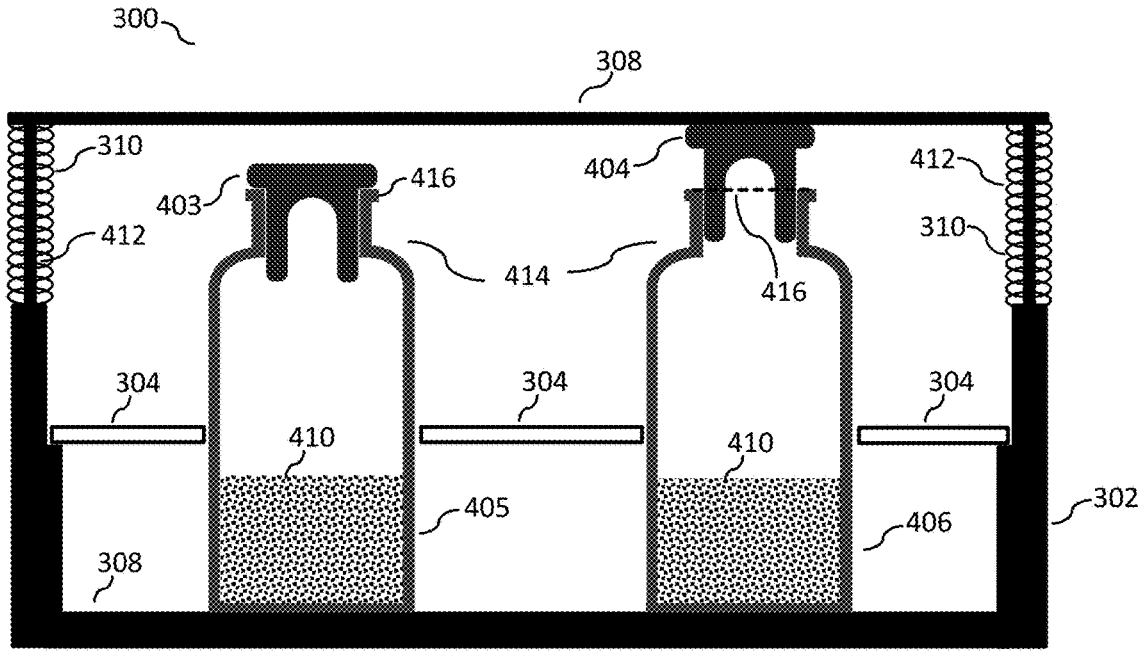
FIG. 4 is a side view perspective view of side view of a tray package according to an embodiment of the present invention containing two vials.

A side view of a simplified tray package 300 including only two vials 405, 406 carrying a substance to be lyophilized 410 inside is shown in FIG. 4. Elements corresponding to elements of the tray package 300 already explained based on FIG. 3 carry the same reference numbers and will not be described again.

In the embodiment of the tray package 300 shown in FIG. 4, the dynamic elements 310 are configured as springs. The tray package 300 is shown in its quiescent state where no force (except the weight force of the lid 308) is acting on the dynamic elements 310 and thus the lid 308 is in its quiescent position. The left vial 405 is shown in a closed state, i.e. with the left stopper 403 in the closed state. Since the stopper is completely inserted into the neck portion 414 of the left vial 405, no gas exchange between the inside and the outside of the left vial 405 can take place. The right vial 406 is shown in the exchange state, i.e. with the right stopper 404 in the exchange state, such that the vial 406 is partially stoppered and ventilation openings extend above the right vial 406. It is to be mentioned that even though only a lyo (lyo: abbreviation for lyophilization) stopper 403, 404 of the two leg type is illustrated in FIG. 4, stoppers of the iglu type as well as other types of lyo stoppers may also be used. Consequently, in the case of the right vial 406, gas exchange between the inside and the outside of the vial can take place. The lid 308 may further comprise optional protrusions on its inner side (not shown in FIG. 4). The protrusions may be used in order to fine tune the distance between the inner surface of the lid 308 and the container 302 or the upper rims 416 of the vials 405, 406 provided therein to the required value. However, instead of providing the protrusions this distance may be adjusted by modifying the dynamic elements 310. The optional protrusions may take any shape such as trapezoidal, quadratic or cylindric and may be, for example, formed by embossing, i.e. by deforming the originally flat lid 308 locally such that the thickness of the lid 308 substantially remains the same. In general, the material of the lid may be different from the material of the protrusions. For example, while the lid 308 may comprise a metal, the protrusions may include a soft material which will not scratch or damage the upper rims of the vials 405, 406 when it comes in contact with those.

The distance between the inner surface of the lid 308 and the container 302 or the upper rims 416 of the vials 405, 406 provided therein in the quiescent state of the lid 308 is configured such that the upper surface of the stopper 404 in the exchange state may touch the inner surface of the lid 308 as shown in the case of the right vial 406 in FIG. 4.

The embodiment of the tray package 300 shown in FIG. 4 further comprises optional guiding elements 412 which restrict the motion of the lid 308 to a one-dimensional movement, i.e. along the axis defined by the guiding elements 412. In this embodiment the guiding elements 412 are configured as rods which extend from the inner surface of the lid 308 downwards into hollow ducts (not explicitly shown in FIG. 4) which are provided in the sidewalls of the 302 just below the guiding elements 412. During movement of the lid 308, the guiding elements 412 slide into the hollow ducts and confine the motion of the lid 308 to a uniaxial motion. Here, the guiding elements 412 are implemented into the dynamic elements 310, i.e. provided as one unit. In other embodiments, the guiding elements 412 may be provided separately from the dynamic elements 310. For example, while the springs 310 in FIG. 4 are provided at corner positions, each of the guiding elements 412 may be provided at some position along any one side of the container 302. The number of guiding elements 412 may be generally different from the number of dynamic elements 310. For example, three guiding elements 412 of the kind shown in FIG. 4 will suffice to guarantee a uniaxial motion of the lid 308, i.e. without any torsion and/or shifts of the lid 308 to the sides.

The guiding elements 412 in FIG. 4 simultaneously fulfill the role of spacer elements, defining a maximum distance between the lid 308 and the box 308 or the upper rims 416 of the vials. The length of the guiding elements 412 (or the depth of the hollow ducts, respectively) may be configured such that the guiding elements 412 hit the bottom of the hollow ducts once a desired end position of the lid 308 has been reached. Thus, in the embodiment of the tray package 300 shown in FIG. 4 the guiding elements 412 may be additionally seen as safety elements which prevent the lid 308 from being pushed too far towards the container 302 and damaging the vials 405, 406. Depending on the actual implementation of the dynamic elements 310, the guiding elements 412 and the spacer elements, the spacer elements may be provided as separate elements which are independent from the other two.

In FIGS. 5A to 5D, the technical implementation of the method for lyophilizing a substance according various embodiments based on a closure device 504 as disclosed herein is depicted. In each of the figures, a different stage of the lyophilization process is shown. In each of the figures a vial 405 filled with the substance to be lyophilized 410 is shown which is arranged on a lower shelf or shelving plate 502. Above the vial 405, an upper shelf or shelving plate 308 is provided which was already shown in FIG. 4. In the simplified application example shown in FIGS. 5A to 5D, the tray package is omitted and the view is focused on one vial only, the one exemplary vial shown being representative of a batch of vials which are processed in a lyophilization chamber. However, the lower portion of the tray package including at least the container and the holding element for secure holding of vials may be of course provided. The lid may be omitted as its function is provided by the closure device 504 arranged on the neck of the vial 405.

Figure 5A:
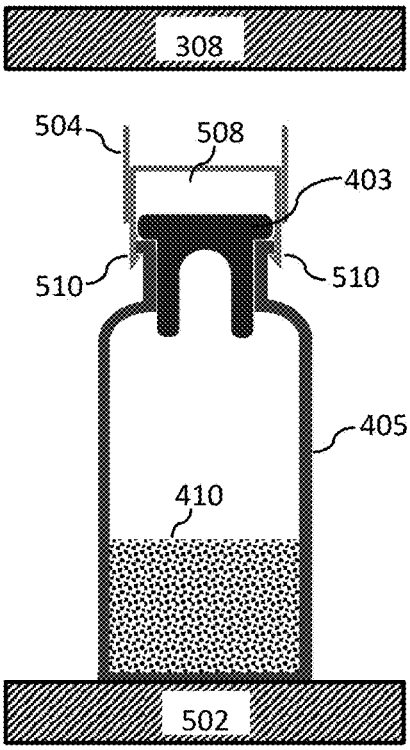
FIGS. 5A to 5D show the technical implementation of the method for lyophilizing a substance according various embodiments using a closure device as disclosed herein.

FIG. 5A shows a stage of the lyophilization process in which the vial 405 is located in the lyophilization chamber. The stopper 403 is in the closed state, preventing a gas exchange between the interior and exterior of the vial 405. The closure device 504 is arranged at the opening of the vial 405. As can be seen, at this stage there is a hollow space 508 above the stopper 403 which is enclosed by the closure device 504. In other words, the closure device 504 is configured such that, when placed on the neck of the vial 405, it encloses a hollow space 508. The closure device 504 may include fastening means 510 by which the closure device 504 may be attached to the rim of the vial 405.

Figure 5B:
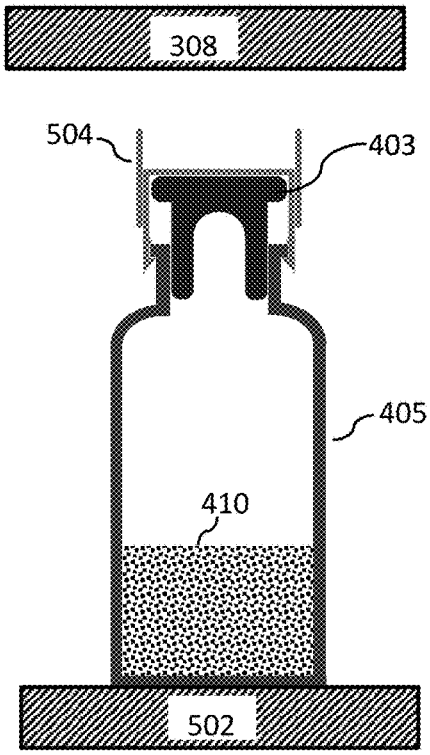

FIG. 5B shows a stage of the lyophilization process in which the stopper 403 has been moved from the closed state as shown in FIG. 5A into the exchange state. As described previously, this can be done by creating a vacuum in the lyophilization chamber. The resulting buildup of a relative overpressure inside the vial 405 causes the stopper 403 to be pushed out of the opening of the vial 405 at some point during buildup of the vacuum. As can be seen in FIG. 5B, after the stopper 403 has been pulled out of the opening of the vial 405, it advances into the hollow space 508. The closure device 504 may be configured such that the hollow space 508 is explicitly adjusted to the stopper 403, e.g. the upper part of the stopper 403, in the sense that the stopper 403, when being lifted from the closed state, may advance into the hollow space 508 without any hindrance from the closure device 504. At this stage of the process, the stopper 403 is in the exchange state and permits a gas exchange between the interior and exterior of the vial 405. It goes without saying that the closure device 504 is configured such that in its unsealing state (i.e. as shown in FIG. 5A) it does not form a hermetic seal around the opening of the vial 405. In other words, the closure device 504 includes openings or channels which, in the unsealing state thereof, permit gas exchange between the interior of the vial 405, the hollow space 508 and the surrounding atmosphere.

Figure 5C:
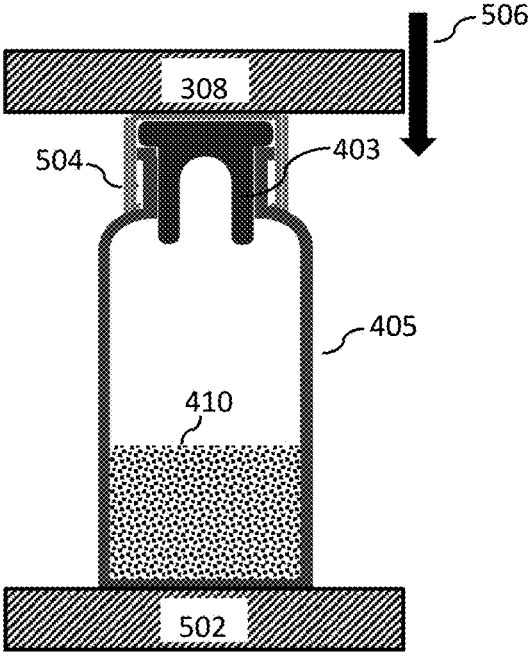

FIG. 5C shows a stage of the lyophilization process in which the upper shelf 308 has been collapsed towards the lower shelf 502 and thereby towards the upper portion of the closure device 504, as indicated by the arrow 506. This step may be performed after the lyophilisate has been frozen and subsequently dried. The lowering of the upper shelf 308 from its position shown in FIG. 5B towards the vial 405 is used to exert pressure on the closure device 504. The closure device 504 is constructed such that it may be collapsed and thus the upper shelf 308 ultimately pushes the stopper 403 into the opening of the vial 405. In other words, in this step the vial 405 is closed by bringing the stopper 403 into the closed state back again. The closure device 504 may have an outer part and an inner part which are movable with respect to one another when pressure is applied to at least one of the parts. In this example, when pressure is applied to the outer part of the closure device 504, i.e. the part indicated by the two antenna-like portions at each side of the closure device 504, the fastening means 510 may be configured to unlock by the relative movement of the outer part of the closure device 504 towards the inner part of the closure device 504 such that eventually the whole closure device 504, while being arranged on the neck portion of the vial 405, is pushed downwards. It may be seen that during this process the hollow space 508 is collapsed by the closure device 504 advancing downwards on the neck portion of the vial 405. In the final state of the closure device 504 as shown in FIG. 5C, i.e. when the stopper 503 has been pushed into the opening of the vial 405, the closure device 504 may be configured to form a hermetic seal around the opening of the vial 405.

Figure 5D:
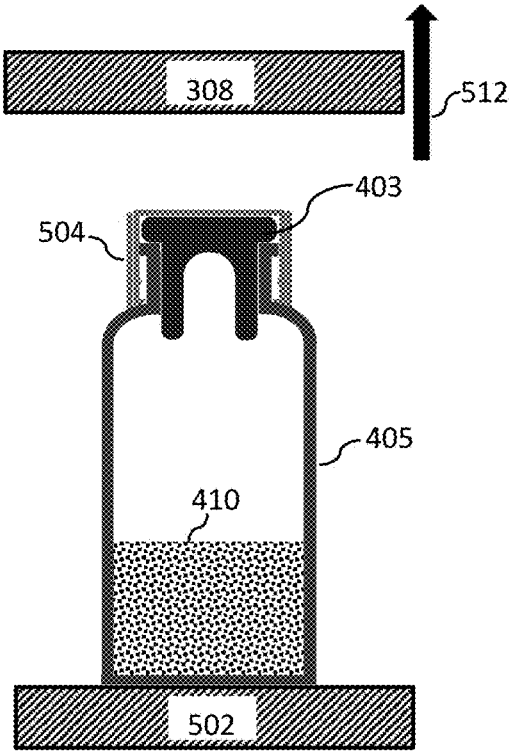

Finally, in FIG. 5D, the final stage of the lyophilization process is shown in which the upper shelf 308 is lifted back up to its default position as indicated by the arrow 512. The closure device 504 remains in its sealing state arranged around the opening of the vial 405 which is hermetically sealed and may be unloaded from the freeze drying chamber.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

The invention claimed is:

1. A method for lyophilizing a substance comprising the steps of:

placing at least one vial containing the substance in a lyophilization chamber, the at least one vial having an opening in which a stopper is inserted in a closed state in which the stopper does not allow gas exchange between the interior and exterior of the at least one vial;

providing mechanical means external to the stopper and arranged at the opening for restricting an upward movement of the stopper;

lowering the temperature within the lyophilization chamber to a predefined value below the freezing temperature of the substance; and reducing the pressure within the lyophilization chamber to a predefined pressure, the predefined pressure being chosen such that the force exerted by it on the stopper lifts the stopper from the closed state to an exchange state in which the stopper is only partly inserted in the opening of the at least one vial allowing gas exchange between the interior and exterior of the at least one vial;

wherein the lowering of the temperature within the lyophilization chamber to the predefined value is performed before reducing the pressure within the lyophilization chamber to the predefined pressure; and wherein lifting the stopper from the closed state abruptly lowers the pressure within the at least one vial which initiates nucleation in the substance within the at least one vial.

2. The method for lyophilizing according to claim 1, wherein the mechanical means define a maximum portion of the stopper which can protrude outwardly from the opening of the at least one vial in the exchange state.

3. The method for lyophilizing according to claim 1, wherein the mechanical means are configured to prevent the stopper from falling off the opening of the at least one vial when the stopper is lifted from the closed state.

4. The method for lyophilizing according to claim 1, wherein providing the mechanical means external to the stopper for restricting the upward movement of the stopper includes positioning of shelves within the lyophilization chamber at a predefined distance from each other.

5. The method for lyophilizing according to claim 1, wherein providing the mechanical means external to the stopper for restricting the upward movement of the stopper includes providing a closure device on a neck of the at least one vial which encloses a space above the opening of the at least one vial thereby being configured to restrict the upward travel of the stopper when it is lifted from the closed state into the exchange state.

6. The method for lyophilizing according to claim 5, further comprising the step of:

forcing the stopper into and securing it in the closed state after the lyophilization process by pressing the closure device onto the neck of the at least one vial.

7. The method for lyophilizing according to claim 1, wherein providing the mechanical means external to the stopper for restricting the upward movement of the stopper includes placing the at least one vial into the lyophilization chamber in a tray package having a container and a lid, the lid being held at a predefined distance from the container by dynamic elements, the lid being configured to restrict the upward travel of the stopper when it transitions from the closed state into the exchange state.

8. The method for lyophilizing according to claim 1, wherein the predefined pressure corresponds to a pressure value of 800 mbar or less.

* * * * *